US007837409B2

(12) United States Patent
Mahal et al.

(10) Patent No.: US 7,837,409 B2
(45) Date of Patent: Nov. 23, 2010

(54) VEHICLE INCURSION INHIBITORS

(75) Inventors: Peter T. Mahal, Berwyn, PA (US); Hugh Kenneth De Long, III, Jeffersonville, PA (US); G. Kent Thompson, Media, PA (US); Daniel J. Edwards, Burlington, NJ (US); Yijian Shi, Swedesboro, NJ (US); Gerald T. Cox, Jr., Bear, DE (US); Roosevelt Reid, Philadelphia, PA (US)

(73) Assignee: Engineered Arresting Systems Corporation, Aston, PA (US)

( * ) Notice: Subject to any disclaimer, the term of this patent is extended or adjusted under 35 U.S.C. 154(b) by 292 days.

(21) Appl. No.: 11/542,446

(22) Filed: Oct. 3, 2006

(65) Prior Publication Data

US 2007/0077118 A1 Apr. 5, 2007

Related U.S. Application Data

(60) Provisional application No. 60/723,121, filed on Oct. 3, 2005.

(51) Int. Cl.
*E01C 9/00* (2006.01)

(52) U.S. Cl. ..... 404/6; 404/27; 188/371

(58) Field of Classification Search ..... 404/6, 404/10, 17, 27, 28, 31, 71; 188/371, 376, 188/377
See application file for complete search history.

(56) References Cited

U.S. PATENT DOCUMENTS 3,066,896 A * 12/1962 Schirtzinger ..... 244/114 R
3,967,704 A 7/1976 Ogden
4,007,917 A * 2/1977 Brubaker ..... 256/13.1
4,554,695 A * 11/1985 Rowland ..... 14/69.5
4,647,246 A 3/1987 Brink et al.
5,193,764 A * 3/1993 Larratt et al. ..... 244/110 R
5,322,385 A 6/1994 Reisman
5,330,285 A * 7/1994 Greves et al. ..... 404/6
5,789,681 A 8/1998 Angley et al.
5,820,293 A * 10/1998 Groen et al. ..... 404/6
5,885,025 A 3/1999 Angley et al.
5,902,068 A 5/1999 Angley et al.
6,045,293 A 4/2000 Dickinson
6,155,745 A * 12/2000 Groen et al. ..... 404/6
6,685,387 B2 2/2004 Allen et al.
6,726,400 B1 4/2004 Angley et al.
6,971,817 B2 12/2005 Allen et al.
7,121,760 B1 * 10/2006 Curry, Jr. ..... 404/6

(Continued)

FOREIGN PATENT DOCUMENTS

WO WO 98/35099 8/1998

OTHER PUBLICATIONS

International Search Report in related Application No. PCT/US2006/038798.

*Primary Examiner*—Gary S Hartmann
(74) *Attorney, Agent, or Firm*—Dean W. Russell; Kilpatrick Stockton LLP

(57) ABSTRACT

Detailed are systems and techniques for protecting structures from vehicular attack. The systems incorporate deformable materials sufficient to disable or otherwise inhibit certain vehicular traffic yet support weights and weight distributions typically associated with pedestrian or other non-threat traffic. Bodies of deformable materials further may include rigid structures or vehicle-immobilization devices.

2 Claims, 3 Drawing Sheets

U.S. PATENT DOCUMENTS 7,128,496 B2 * 10/2006 Rogers et al. ..... 404/7
7,214,000 B2 * 5/2007 Marsh et al. ..... 404/6
7,371,029 B2 * 5/2008 Rogers et al. ..... 404/7
2006/0018711 A1 1/2006 Rogers et al.

* cited by examiner

VEHICLE INCURSION INHIBITORS

REFERENCE TO PROVISIONAL APPLICATION

This application is based on and hereby refers to U.S. Provisional Patent Application Ser. No. 60/723,121, filed Oct. 3, 2005, entitled "Collapsible Sidewalk and Similar Assemblies for Facility Protection Against Incursions by Automotive or Other Vehicles," the entire contents of which are incorporated herein by this reference.

FIELD OF THE INVENTION

This invention relates to systems and techniques for inhibiting vehicle movement in an area of interest and more particularly, but not exclusively, to systems incorporating compressible or other deformable materials that may hamper certain vehicular movement while admitting, for example, pedestrian or other traffic.

BACKGROUND OF THE INVENTION

Terrorist targets may include buildings, monuments, or other fixed (or slowly-moving) structures located in urban or suburban areas. Because of their static locations in, typically, well-paved places, these fixed structures may be particularly susceptible to attacks by automobiles, trucks, buses, or other land-based vehicles. Vehicular traffic indeed is common on roadways adjacent to many of these fixed structures; should a threat vehicle exit a roadway and approach an unprotected fixed structure rapidly, it conceivably could impact the structure, or come sufficiently close to the structure to damage it via detonation of on-board explosives, before countermanding action may occur.

Accordingly, various systems have been designed to protect fixed structures from land-based vehicular attack. Guard posts with moveable barriers ("check points") constitute one mechanism for deterring threat vehicles, for example. Other mechanisms include bollards (or other posts) positioned either in a roadway or between a roadway and an object to be protected. Existing bollards may either be embedded in the ground or in a suitable foundation or elevated from a storage position underground to a raised, above-ground position. The former bollards are frequently referred to as "passive" devices, as their positions are fixed, while the latter bollards—and other moveable barriers—are denoted "active" ones.

Another fixed-object protective system is disclosed in U.S. Patent Publication No. 2006/0018711 of Rogers, et al., published after the filing date of the provisional application to which this application claims priority. Detailed in the Rogers publication is a four-part vehicle barrier system. In a first part, roadway surfaces and traffic patterns are devised to reduce maximum travel speeds of moving vehicles. Thereafter, vehicles exiting legitimate roadways must traverse a "first impact element" (typically a curb), a deformable bed, and a "second impact element" (such as a wall) before transiting to the protected structure. In combination, these elements are intended to arrest forward motion of the vehicle.

Identified in the Rogers publication as constituting the deformable bed is compressible cellular concrete of Engineered Arresting Systems Corporation (ESCO), the assignee of this application. See Rogers ¶ 0038. Among patents issued to ESCO's predecessor-in-interest is U.S. Pat. No. 5,789,681 to Angley, et al., which describes utilizing beds of cellular concrete to decelerate vehicles including landing fixed-wing aircraft past ends of runways. Because weights and speeds of landing aircraft are high relative to those of land-based vehicles, arresting beds must be of substantial strength to slow the aircraft without damaging it. As noted in the Angley '681 patent, cellular concrete may be formulated to have adequate strength for this purpose.

Also described in the Angley '681 patent are apparatus and methods of determining compressive gradient strength (CGS) of arresting materials. For purposes of arresting runaway aircraft, materials having CGS of approximately 60/80 or 80/100 usually are used. See, e.g., U.S. Pat. No. 5,885,025 to Angley, et al., col. 4, 11. 5-10. However, such materials may not deform adequately to arrest vehicles of lesser weights.

Accordingly, ESCO developed cellular concrete of lower CGS for land-based vehicle arresting purposes. Further, because the four-part system of the Rogers publication is impractical in some situations, alternatives to these systems need be devised. Such alternative systems beneficially may inhibit vehicle incursions without need of the first and second impact elements of the Rogers publication, although either or both elements may be included if desired.

SUMMARY OF THE INVENTION

The present invention provides these sorts of alternative protection systems. Incorporated into the systems are deformable materials sufficient to disable certain vehicular traffic yet support weights and weight distributions typically associated with pedestrian or other non-threat traffic. The materials may comprise any deformable substance suitable to accomplish this objective, with presently-preferred materials including either or both of low-CGS cellular concrete and foamed glass. Hollow shapes of ceramic or glass additionally may form or be incorporated into the deformable materials.

Consistent with the present invention, deformable materials may be positioned above, at, or below grade. Examples of above-grade positioning include ramps and steps, while below-grade positioning may, for example, be in the form of beds within pits. Plastics or other water-impervious or -inhibiting materials may be coated onto or laminated or otherwise attached or bonded to the deformable materials to limit or prevent egress of moisture. Otherwise exposed surfaces of the deformable materials may be covered by cobblestones, pavers, dirt, or other landscaping supplies, with the coverings functioning (at least in certain circumstances) to distribute loads over different areas. Such coverings additionally may be selected to improve aesthetic appeal of the systems, as they tend to mask (disguise) the presence of the deformable materials. In any event, the coverings are not intended to support the weight of a threat vehicle, although combinations of coverings and deformable materials preferably support expected pedestrian loads.

Bodies of deformable materials of the invention—whether located above, at, or below grade—further may include either or both of rigid (i.e. generally non-deformable) structures or vehicle-immobilization devices. In one embodiment of the invention, tire-shredding devices are incorporated into a below-grade bed of deformable material. Not only do these devices decelerate vehicles by increasing frictional (drag) forces to which the vehicles are subjected, they also both lower vehicle heights relative to grade (by decreasing air pressure within the tires) and change the point-load characteristics of vehicles within the bed. This latter result further distinguishes vehicle load profiles from those of average pedestrian traffic, enhancing ability of the innovative systems to be optimized for their primary purposes.

Other versions of the invention alternatively or additionally utilize anchored cables with vehicle grabbing hooks. An exemplary version of this type may operate conceptually similar to anchor and tailhook systems employed to arrest airplanes landing on, for example, aircraft carriers, although land-based vehicles likely will themselves lack tailhooks. Accordingly, vehicle-grabbing hooks of the invention systems will be positioned in conjunction with the deformable materials.

Versions of deformable materials containing cellular concrete may (but need not necessarily) have wet density of 10-25 pounds per cubic foot (pcf) and preferably (although again not necessarily) have CGS less than 60. If desired, the concrete may be formed in blocks, with an array of blocks comprising the overall threat-inhibiting system. Regardless of composition, the deformable materials preferably remain deformed following contact with threat vehicles; otherwise, they might not function adequately to arrest or disable the vehicles.

Systems of the present invention alternatively may comprise pits or other areas that are generally hollow (i.e. lacking any bed of deformable material). These areas, denominated "air moats," typically may (but need not necessarily) include one or more vehicle-immobilization devices masked by a covering. Should a threat vehicle encounter such an area, it will break through the covering into the hollow portion and engage the vehicle-immobilization devices.

It is an optional, non-exclusive object of the present invention to provide systems and techniques for disabling certain vehicular traffic while not inhibiting pedestrian or certain other non-threat traffic.

It is also an optional, non-exclusive object of the present invention to provide systems and techniques for positioning deformable materials above, at, or below grade.

It is another optional, non-exclusive object of the present invention to provide systems and techniques for inhibiting vehicle incursions utilizing cellular concrete or foamed glass as compressible material.

It is a further optional, non-exclusive object of the present invention to provide systems and techniques for covering deformable materials so as to mask the presence of such materials and, in some cases, redistributing loads.

It is an additional optional, non-exclusive object of the present invention to provide systems and techniques for inhibiting vehicle incursions by incorporating immobilization devices into the deformable materials.

Other objects, features, and advantages of the present invention will be apparent to those skilled in appropriate fields by reference to the remaining text and drawings of this application.

DETAILED DESCRIPTION

Figure 1:
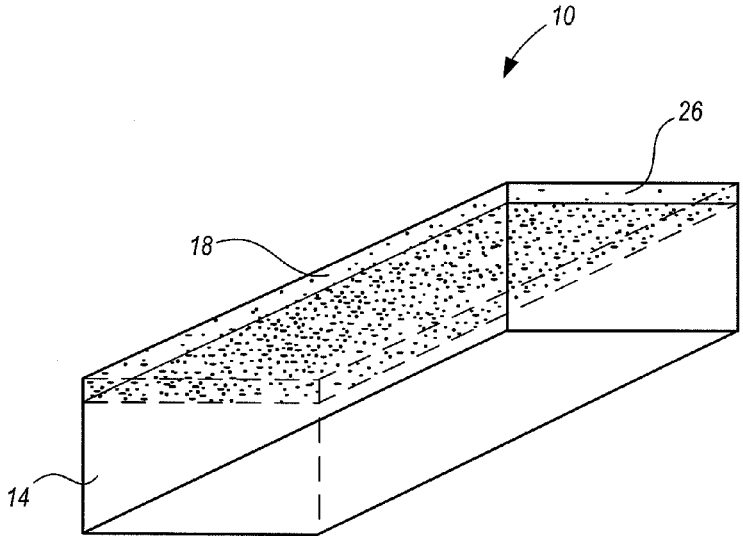
FIG. 1 illustrates an exemplary block of deformable material.

FIG. 1 depicts exemplary block 10 of the present invention. As shown, block 10 may comprise material 14 together with exterior layer 18. Material 14 may be or include any substance suitable for arresting (or at least inhibiting) movement of certain vehicles while supporting weight of and permitting transit of pedestrians. Material 14 preferably is collapsible, or otherwise permanently deformable, under weight of vehicles that could be used to attack buildings, monuments, or other fixed or relatively immobile structures. In some preferred versions of the invention, material 14 comprises cellular concrete having CGS less than sixty and wet density between 10-25 pcf. Alternatively or additionally, material 14 may comprise foamed glass.

Block 10 may have any dimensions appropriate for its intended purposes. An exemplary version of block 10 has length and width of forty-eight inches and depth of twenty-six inches. Other examples of block 10 may have depths between 15-36 inches and, like the version of FIG. 1, need not have identical lengths and widths.

Exterior layer 18 may be coated, applied, bonded, laminated, mechanically connected, or otherwise attached to material 14. Some versions of block 10 include as exterior layer 18 a plastic coating surrounding all sides of block 10. Such plastic (or similar) coating is intended to be water-impervious or -inhibiting so as to impede moisture ingress into material 14. Exterior layer 18 also may serve to channel water or other liquids to edges of a block 10 for drainage or to protect joints between adjacent blocks 10. Layer 18 further may function as a base for any loose material additionally covering block 10.

Figure 4:
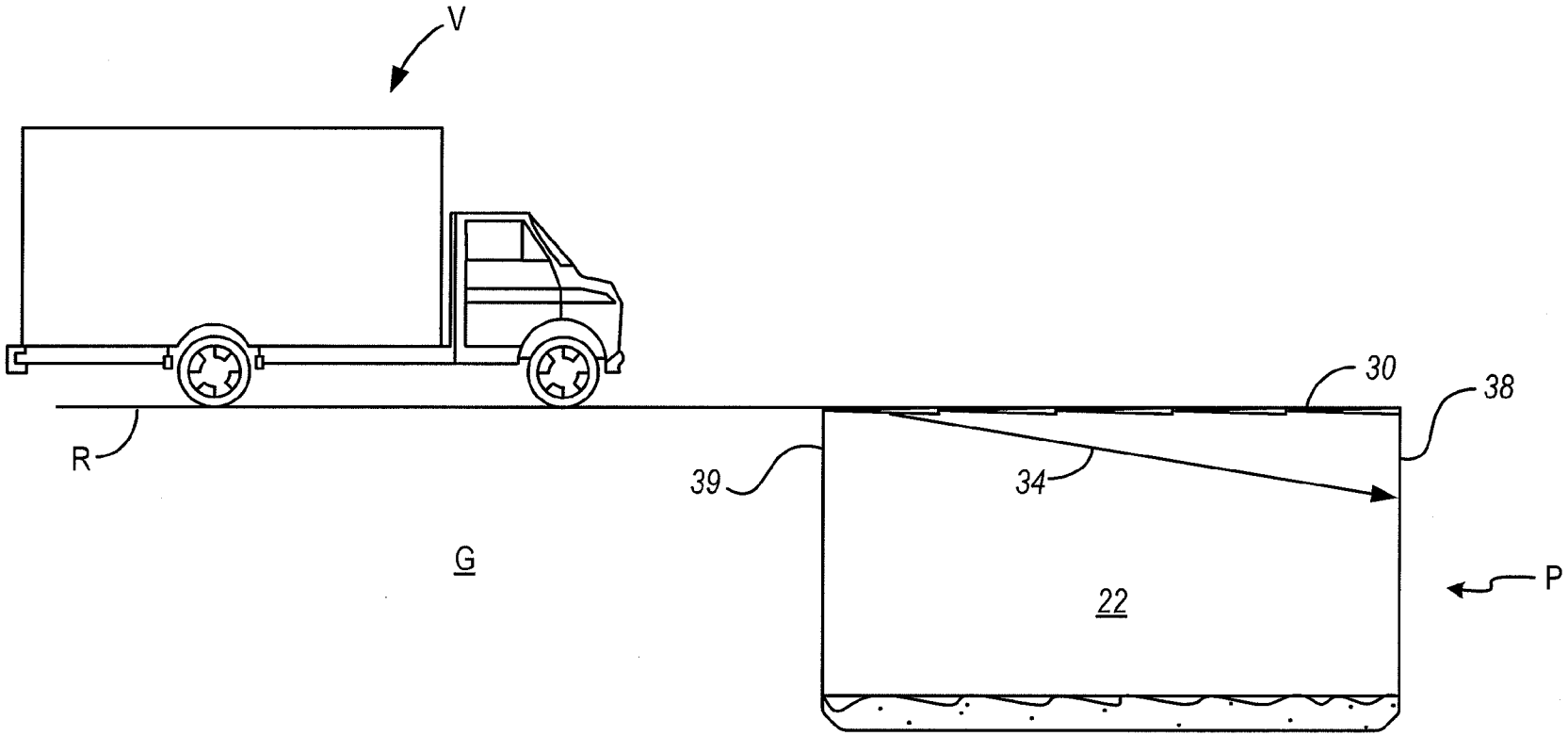
FIG. 4 illustrates a bed of deformable material, indicating an exemplary travel path of a threat vehicle within the bed.

Multiple blocks 10 may be installed in an array to form arresting bed 22 (FIG. 4). Depicted in FIG. 4 is bed 22 extending below grade (i.e. below roadway R), having been fitted into pit P dug into the ground G or otherwise formed in a foundation. If desired, pit P may be bounded with solid matter on its bottom, top, or sides. Because blocks 10 are pre-formed, such solid matter is not needed to retain material 14 from spreading; instead, the solid matter would be used as another barrier to protect against moisture entering into material 14.

Alternatively or additionally, bed 22 may be positioned above grade. For example, bed 22 may comprise a series of steps leading to or from an object. Bed 22 may instead comprise a ramp, bridge, or other transit-facilitating structure.

For blocks 10 of bed 22 positioned at or above grade, otherwise exposed surfaces 26 may be subject to some sort of treatment 30. In these instances, treatment 30 may comprise any or all of cobblestones, pavers, dirt, or other landscaping supplies laid atop surfaces 26 and which, if desired, may be pleasing aesthetically to pedestrians. However, treatment 30 may have functional attributes as well, as it serves both to mask or disguise the existence of material 14 (thereby avoiding informing terrorists of the presence of bed 22) and, at least in some circumstances, to redistribute loads to which blocks 10 of bed 22 otherwise would be exposed. Indeed, appropriate selection of treatments 30 for a particular bed 22 may facilitate differentiating pedestrian and threat loads to which bed 22 may be subjected, allowing CGS and other characteristics of material 14 to be optimized for the particular bed 22.

FIG. 4 illustrates, somewhat schematically, a threat vehicle V—in the form of a truck—exiting roadway R toward bed 22 (covered by treatment 30). As vehicle V loads bed 22, treatment 30 and material 14 will begin collapsing (or otherwise deforming), increasing drag on and thereby inhibiting continued movement of the vehicle V. Arrow 34 generally indicates the path of vehicle V in bed 22; at remote end 38 of bed 22, vehicle V will be sufficiently below grade and travelling sufficiently slowly as to be unable to return to grade. Hence, the multiple "impact elements" of the Rogers publication are not required to be used in connection with the present invention, nor are any special traffic patterns or roadway surfaces needed.

Certain preferred versions of bed 22 comprise blocks 10 of generally uniform depth and generally uniform CGS. The majority of blocks 10 preferably are shaped as rectangular solids. However, some or all of blocks 10 need not be so shaped, depending on the shape or type of area in which they are to be placed. Likewise, blocks 10 in an array need not have uniform depth, nor need they have uniform CGS. (As an example, blocks 10 adjacent entry end 39 of bed 22 may have lesser CGS than blocks 10 adjacent remote end 38; this configuration lowers vehicle V quickly into bed 22 and then slows its speed.) Weights of individual blocks 10 within a bed 22 preferably are within thirty percent of the average weight for all blocks 10 within the bed 22.

Figure 2:
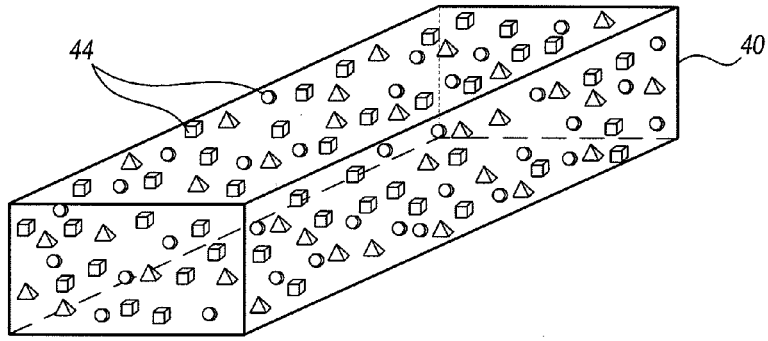
FIG. 2 illustrates a first alternative block of deformable material into which hollow forms have been incorporated.

FIG. 2 details a first alternate block 40 of the present invention. Block 40 may be similar to block 10 in many respects. However, incorporated into block 40 are one or more discrete items 44. Items 44 may be hollow and preferably are crushable so as to assist material 14 in arresting movement of vehicle V. Non-limiting examples of items 44 include hollow shapes of ceramic or glass.

Figure 3A:
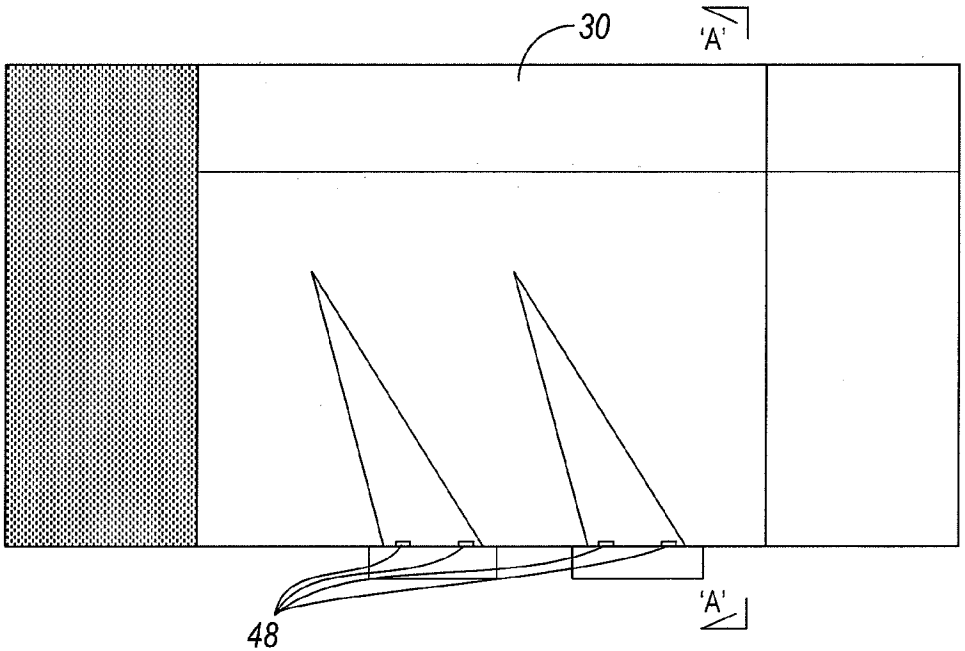
FIG. 3A is a side view of a bed of deformable material into which at least one vehicle immobilization device has been incorporated.
Figure 3B:
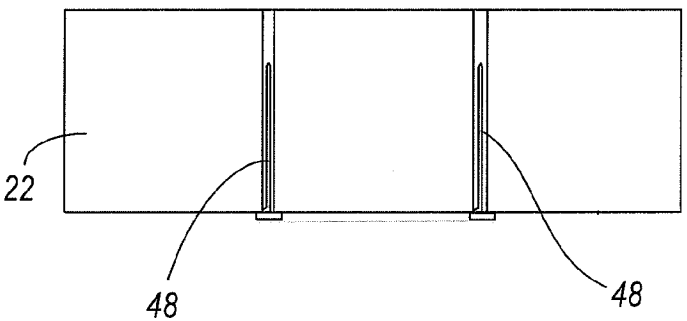
FIG. 3B is a cross-sectional view taken along lines A-A of FIG. 3A.

Illustrated in FIGS. 3A-B is bed 22 into which vehicle-immobilization devices 48 have been placed. As depicted, devices 48 comprise sharp objects intended to puncture (inflated) tires of vehicle V. Devices 48 need not be formed as shown in FIGS. 3A-B, however; instead, they may comprise one or more of any mechanism designed to reduce mobility of a threat vehicle entering bed 22.

The foregoing is provided for purposes of illustrating, explaining, and describing embodiments of the present invention. Modifications and adaptations to these embodiments will be apparent to those skilled in the art and may be made without departing from the scope or spirit of the invention. The contents of the Rogers publication, the Angley '681 patent, and the Angley '025 patent are incorporated herein in their entireties by this reference.

What is claimed is:

1. A system for arresting movement of a land-based vehicle in an area off-limits to land-based vehicles, comprising:

a. a below-grade region comprising deformable material configured to (i) deform substantially under weight of a vehicle so as to arrest its movement and (ii) not deform substantially under weight of loads existing when a vehicle is not present, the deformable material (i) installed in the below-grade region as a bed having an entry end and a remote end opposite the entry end and (ii) remaining deformed after encountering weight of a vehicle;

b. a region at or above grade (i) forming a boundary of at least a portion of the below-grade region and (ii) in which (A) a covering exists over at least a portion of the below-grade region so as to mask the presence of the below-grade region, (B) no above-grade wall or curb is present at or adjacent the remote end of the bed, and (C) the covering is configured to fail under weight of a vehicle sufficient so as to expose at least part of the below-grade region; and c. means, incorporated into the bed, for altering point-load characteristics of a vehicle so as to decelerate it within the bed.

2. A system according to claim 1 in which the deformable material comprises at least one of cellular concrete or foamed glass.

* * * * *